United States Patent [19]

Hedger

[11] 4,213,377

[45] Jul. 22, 1980

[54] RECIPROCATING ENGINE WITH IMPROVED POWER OUTPUT MEANS

[76] Inventor: John H. Hedger, P.O. Box 357, Lakeside, Calif. 92040

[21] Appl. No.: 970,862

[22] Filed: Dec. 18, 1978

[51] Int. Cl.[2] ..... F01L 31/08; F01B 1/00

[52] U.S. Cl. ..... 91/187; 91/186; 91/331

[58] Field of Search ..... 91/187, 186, 183, 184, 91/185, 331, 478, 482

[56] References Cited

U.S. PATENT DOCUMENTS

| | | | |
|---|---|---|---|
| 675,959 | 6/1901 | Loomis et al. | 91/187 |
| 1,039,492 | 9/1912 | Courtwright | 91/186 |
| 1,150,830 | 8/1915 | Winslow | 91/187 |
| 1,924,689 | 8/1933 | Knight | 91/187 |
| 2,951,471 | 9/1960 | Hill | 91/187 |

*Primary Examiner*—Paul E. Maslousky
*Attorney, Agent, or Firm*—Frank D. Gilliam

[57] ABSTRACT

A high efficiency, low cost fluid pressure engine. This engine converts reciprocating piston motion to rotary output in a novel manner. The engine comprises at least two parallel pistons adapted to reciprocate in cylinders within an engine block closed by upper and lower heads. Each piston is rigidly secured to a piston rod located along the cylinder centerline and extending through substantially fluid tight packing in the lower head. The lower end of each piston rod is flexibly connected to a first connecting means which also includes an opening surrounding a first crank pin. A pair of reciprocating valve means, located within said engine block, are adapted to selectively introduce and exhaust the engine drive fluid into and out of the cylinder above and below the pistons. Valve push rods secured to said valve means are connected to a second connecting means which also has an opening surrounding a second crank pin. Swinging link means are provided interconnecting each of said first and second connecting means and the engine housing to constrain the movement of the piston rods and valve push rods to substantially linear motion. The first and second crank pins are mounted on a crank plate offset from an output drive shaft so that as steam or another fluid drives the pistons, linear motion is converted to rotary output motion. The crank assembly, which converts piston reciprocating motion to rotary output is made up of several simple parts bolted together to provide a complex assembly including both crank pins, means for adjusting valve timing, balance weights, etc.

3 Claims, 5 Drawing Figures

RECIPROCATING ENGINE WITH IMPROVED POWER OUTPUT MEANS

BACKGROUND OF THE INVENTION

This invention relates in general to power producing engines and, more specifically, to a high efficiency fluid power engine.

Reciprocating engines using expandable gases, such as steam, to drive the pistons have long been used for a variety of purposes. In such engines, individual charges of steam enter the cylinder space, expand against a piston, and are exhausted, this cycle repeating itself at regular intervals. During this cycle the work output is developed due to the difference of pressure on the two sides of the piston working within the cylinder. These differences of pressure vary widely throughout the stroke of the piston and since the reciprocating motion characteristic of the engine must be changed into a rotation for ready utilization of its power output, the design of the engine must usually include a means of storing mechanical energy in certain of its parts, such as a flywheel, sufficient to smooth out the action of the engine and carry it over the dead periods while the direction of motion of the piston is being reversed. Substantial improvement in the weight and complexity of the engine could be accomplished if these "dead periods" could be substantially reduced or eliminated.

External combustion reciprocating engines of this sort have a number of advantages, including high starting torque, wide speed range using manual control, suitability for slow rotative speeds, reversibility of direction of rotation, etc. However, these engines tend to be large and heavy in proportion to output power, and by highly complex and costly per unit capacity.

In converting from reciprocating piston motion to rotary output motion, most engines use a connecting rod connecting the piston to an eccentric crank pin on the output shaft. Conventional internal combustion engines use a wrist pin within the piston so that the connecting rod may move from side to side as the crank pin moves around the output shaft. However, in steam engines having power producing cylinder spaces on both sides of a wide, thin piston, the piston rod must be rigidly fastened to the piston and must move in a straight line through a packing gland. Thus, it is necessary to connect the piston rod to a cross-slide in a housing assuring straight line piston rod movement. A connecting rod then extends from a bearing pin on the cross-slide to the crank pin. This cross-slide and housing arrangement is cumbersome, heavy and expensive to manufacture but is ordinarily considered essential in these engines. Crank shafts on such engines are complex and expensive to manufacture, requiring extensive machining operations, yet do not provide for adjustments.

Thus, there is a continuing need for improved engines having reduced complexity and cost, coupled with higher energy efficiency.

SUMMARY OF THE INVENTION

The above problems, and others, are overcome by a reciprocating engine of the expandable fluid or external combustion type which utilizes at least two parallel pistons connected through a single connecting means to a means for converting reciprocating to rotary motion. Each piston reciprocates in a cylinder within an engine block closed at the upper and lower ends by upper and lower heads. Valve means selectively introduces and exhausts the working fluid into and out of the cylinder on each side of the piston. Rigid piston rods attached to each piston extend through substantially gas tight packing in the lower head. The piston rods are flexibly attached to a first single rigid connecting means which also includes an opening surrounding a crank pin eccentric to a power output shaft. A second connecting means is connected to two valve push rods and includes an opening surrounding a second crank pin. Means is provided to assure that the piston rods move in substantially straight lines as the pistons reciprocate, while the connecting means and eccentric crank pin convert the linear motion to rotary output motion.

BRIEF DESCRIPTION OF THE DRAWING

Details of the invention, and of a preferred embodiment thereof, will be further understood upon reference to the drawing, wherein.

DETAILED DESCRIPTION OF THE INVENTION

Figure 1:
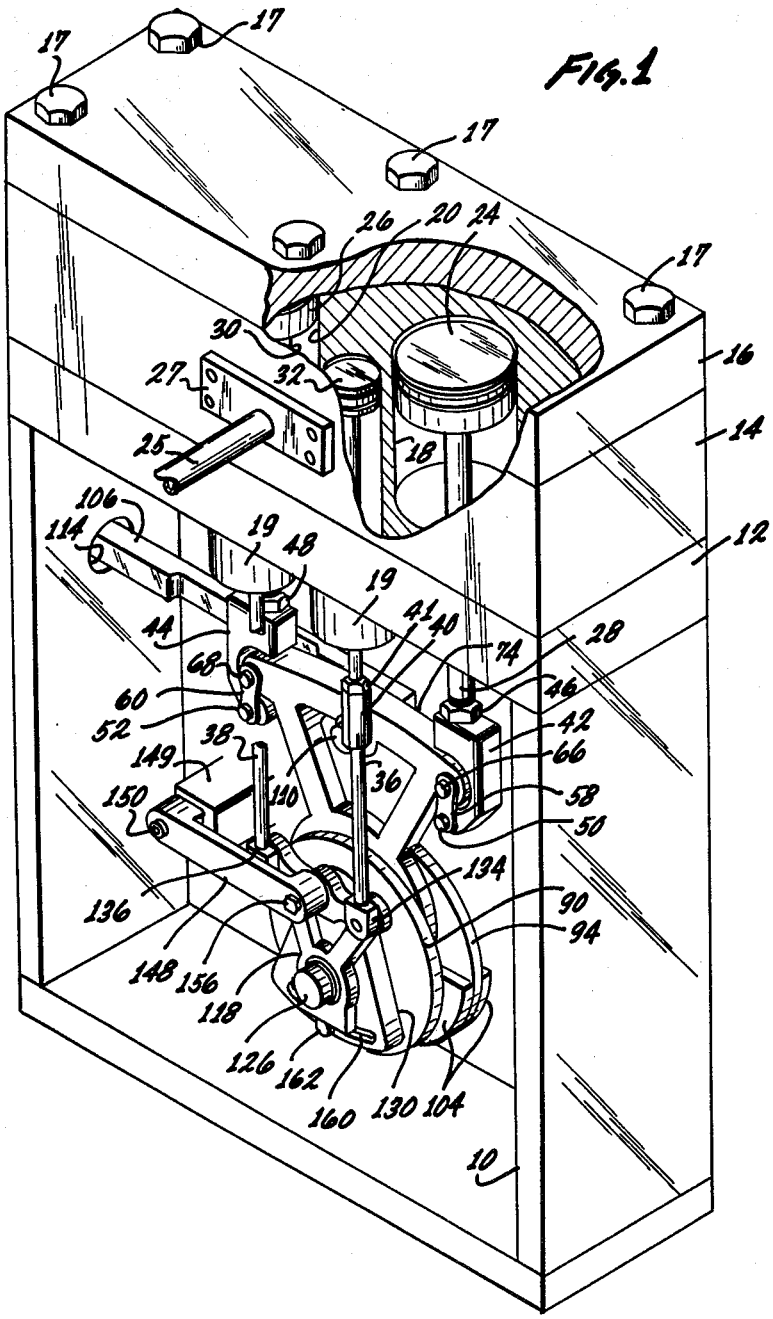
FIG. 1 is a perspective view, partially cut away, of a schematic representation of the engine of this invention.

Referring now to FIG. 1, there is seen a perspective view of an engine according to this invention, with portions cut away to reveal internal components.

This engine includes a basic housing 10 which may be open as shown or closed, as desired. Housing 10 supports a lower head 12, an engine block 14 and an upper head 16. Heads 12 and 16 are secured to block 14 by a plurality of long bolts 17. Two cylinders 18 and 20 are contained within block 14 and heads 12 and 16, as are two valves, one of which is shown at 32.

A pair of wide, thin pistons 24 and 26 are housed within cylinders 18 and 21, respectively. Piston rods 28 and 30 are rigidly attached to pistons 24 and 26, respectively, and lie along the centerlines of the cylinders. The piston rods extend out through the bottoms of the cylinders and lower heads 12. Piston rods 28 and 30 are surrounded by conventional packing (not shown) where they pass through head 12 to prevent fluid leaks out of the cylinders.

Valve bores 22 and 23 (as described in greater detail in the description of FIG. 4, below) contain valve spools 32 and 34, attached to valve stem assemblies or push rods 36 and 38. Valve stem assemblies pass through conventional packing within housings 19 held in place by bolts 21, to prevent leakage of pressurized fluid within the valves. Each valve stem assembly includes a length varying nut 40 of the turnbuckle type and a lock nut 41 for adjusting stem length and, thus, valve spool position within the valve.

Figure 4:
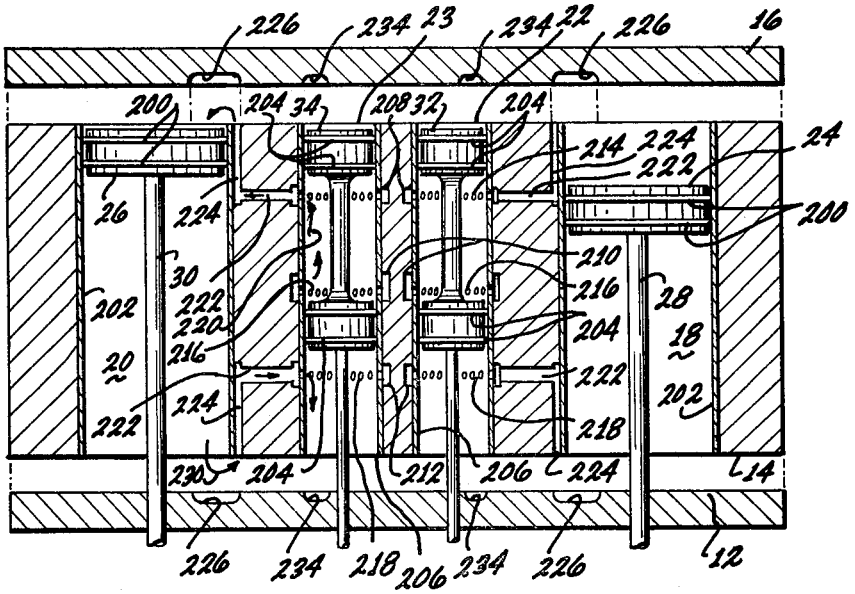
FIG. 4 is a schematic vertical section view through the engine valve means.

Steam or another driving fluid is admitted to bores 22 and 23 through an inlet pipe 25 and channels within bar 27 and holes (not shown) into block 14. The driving fluid is similarly exhausted from bores 22 and 23 through an exhaust pipe (not shown) typically at the back of block 14. Conventional feed channels (as seen in FIG. 4) pass through block 14 from bores 22 and 23 to cylinders 18 and 20 above and below pistons 24 and 26, respectively. These channels are formed in block in a conventional manner during casting of block 14. The flow of fluid to and from the cylinders is schematically illustrated in FIG. 4 and described below.

Figures 2, 5:
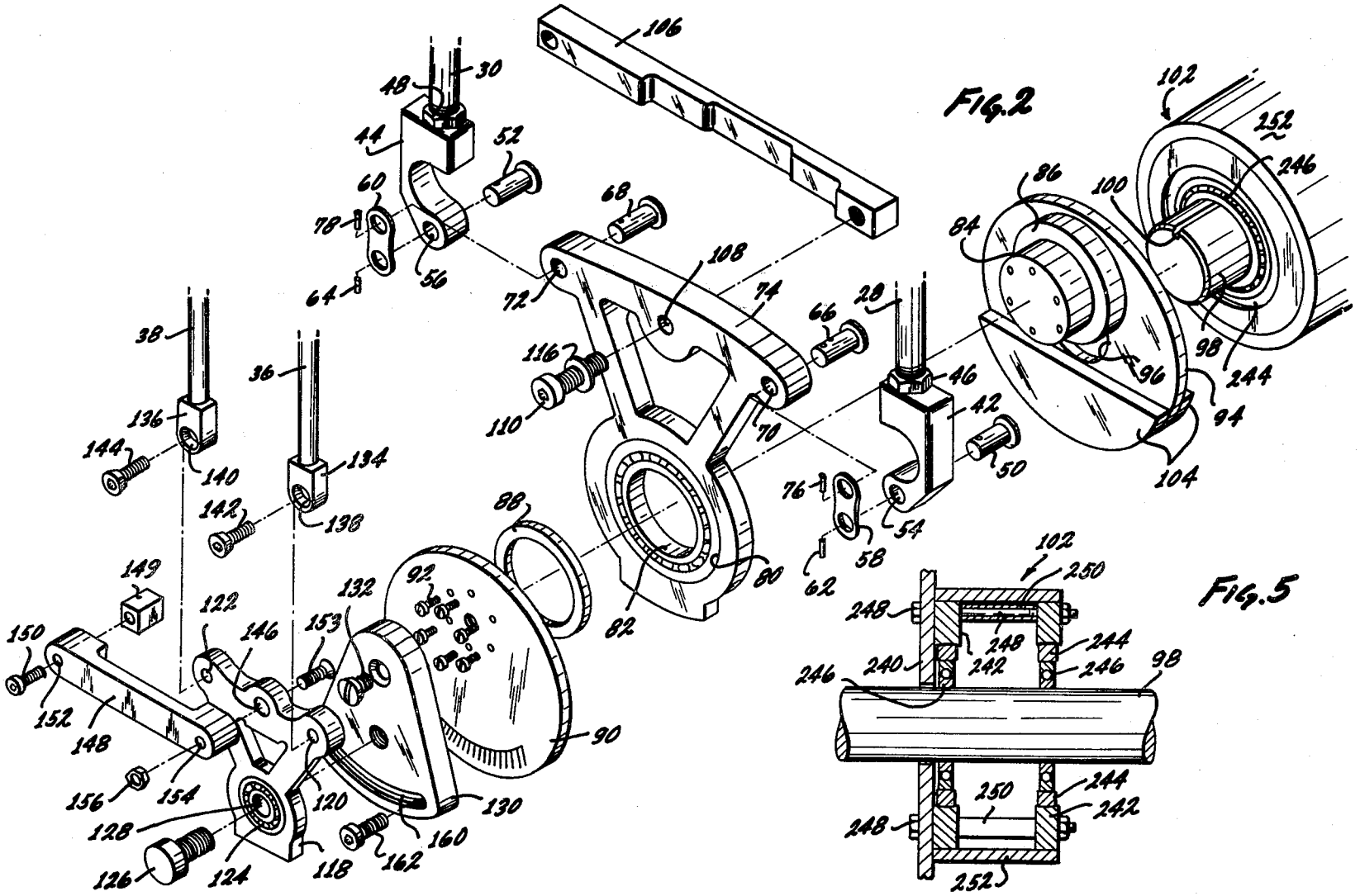
FIG. 2 is an exploded perspective view illustrating the means interconnecting the valves, pistons and output means of the engine.
FIG. 5 is a schematic vertical section view through the engine single main bearing assembly.

The mechanism interconnecting the pistons 24 and 26, valves 32 and 34 and the output means is shown in greatest detail in FIGS. 1 and 2.

The lower ends of piston rods 28 and 30 are threaded into fittings 42 and 44 which have a generally C-shaped or inverted "?"-shaped configuration, and are held in place by nuts 46 and 48. Mounting bolts 50 and 52 extend through openings 54 and 56 in the lower ends of fittings 42 and 44, respectively, then through links 58 and 60 and are held in place by cotter pins 62 and 64. The other ends of links 58 and 60 receive mounting bolds 66 and 68 which have passed through openings 70 and 72 in first connecting means 74. Links 58 and 60 are retained on bolts 66 and 68 by cotter pins 76 and 78.

First connecting means 74 has a large circular opening 80 which contains a bearing 82 and which is fitted to a crank pin 84. Connecting means 74 rests against a shoulder 86 on crank pin 84 and has a spacer 88 in place on the opposite side. This assembly is held together by a timing plate 90 which is fastened to crank pin 84 by a plurality of screws 92. Preferably, screws 92 are unevenly spaced around a circle so that plate 90 can be fastened to crank pin 84 in only a single position, to prevent mis-assembly.

Crank pin 84 is mounted on a crank journal plate 94 offset from a central circular opening 96. A conventional bushing (not shown) is mounted on the back of plate 94, surrounding opening 96. An output shaft 98 is inserted into the bushing and locked to the bushing by a key in keyway 100 in a conventional manner. A main bearing 102 surrounds output shaft 98. Output shaft 98 extends through an opening (not shown) in the back wall of housing 10 (as seen in FIG. 1). Preferrably a conventional bushing (not shown) is rigidly secured to the outer side of that back wall to receive bearing 102. Thus, bearing 102 may be positioned outside of housing 10 and is isolated from any contamination which may be present within housing 10. Weights 104 are provided on plate 94 on the opposite side from crank pin 84 to balance plate 94 during rotation thereof.

In order to constrain the center between openings 70 and 72 of first connecting means 74 to a substantially linear motion during rotation of opening 80 with crank pin 84 around the output centerline, a first stabilizer means including a swinging link 106. Swinging link 106 is connected at one end to central opening 108 in first connecting means 74 by a bolt 110 and at the other end by bold 112 to an extension 114 of housing 10. Link 106 lies along a line substantially perpendicular to piston rods 28 and 30 at the midpoint of piston motion. If link 106 were infinitely long, opening 108 would move up and down in an absolutely straight line while opening 80 revolves with crank pin 84. With the necessarily shorter length, opening 108 moves along an acceptably slightly curved line. Bolts 110 and 112, of course, include conventional washers, such as that shown at 116, to permit free movement of link 106. Thus, piston rods 28 and 30 move in substantially straight lines while transmitting power through first connecting means 74 to output shaft 98.

Valves 32 and 34 are operated through a second connecting means 118 in a substantially similar manner. Second connecting means 118 has a generally triangular configuration similar to that of first connecting means 74, with opening 120 and 122 at the upper corners and circular opening 124 at the lower apex. A bolt 126 passes through a bearing 128 an secures second connecting means 118 to a plate 130 which is in turn fastened to timing plate 90 by a bolt 132 which is aligned with the centerline of crank pin 98.

The lower ends of valve stem assemblies 36 and 38 have fittings 134 and 136 including openings 138 and 140 through which bolts 142 and 144 pass to secure the fittings to openings 120 and 122 in second connecting means 118.

The center, at opening 146, of second connecting means 118, is constrained to substantially linear movement by a second stabilizing means or swinging link 148 which is fastened to block 149 on housing 10 by bolt 150 passing through opening 152 and to connecting means 118 by a bolt 153 passing through opening 154 and opening 146 to nut 156.

Timing of opening and closing (as described in detail below) of valves 32 and 34 with respect to the positions of pistons 24 and 26 is accomplished by a radial slot 160 in plate 130 through which bolt 162 extends. The relative radial position of plate 130 with respect to timing plate 90 may be selected and the plates secured together by bolt 162.

The multi-part crank means is made up of a number of simple, easily manufactured, parts such as output plate 94, timing plate 90, movable plate 130, weights 104, etc. This bolted together assembly has many advantages over the usually entirely machined crank means.

Figure 3:
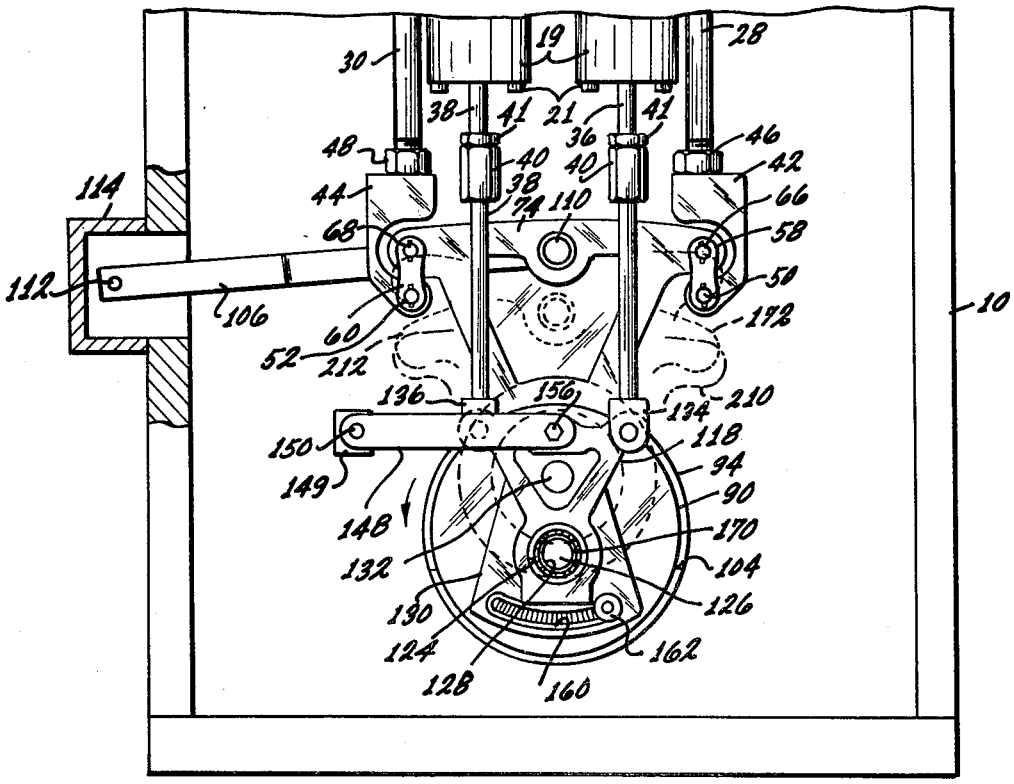
FIG. 3 is a front elevation view of the engine.

The positions of first connecting means 74 at various points during the engine operation cycle are schematically shown by several phantom lines in FIG. 3. As seen in solid lines in FIG. 3, first connecting means 74 is in the uppermost position in the engine cycle, with the center of crank pin 84 (not seen, but indicated by the position of the head of bolt 132) directly above the center of rotation, schematically indicated by point 170 which represents the centerline of output shaft 98. As described in detail below, valve spools 32 and 34 are positioned so that the exhaust pipe (not shown) is connected to cylinders 18 and 20 above pistons 24 and 26. As the crankshaft rotates 90° in a counter-clockwise direction, bolt 132 (representing the centerline of crank pin 84) reaches a position immediately to the left of center point 170. The upper portion of first connecting means 74 is then located in the position schematically indicated by broken line 172. As this movement takes place, second connecting means 118 rocks in the opposite direction, since the center of bearing 128 is below center of rotation 170 while the crank pin 84, represented by bolt 132, is above the center of rotation. As rotation of the output means continues, to a position 180° from the starting position, the upper position of first connecting means 74 reaches the lowermost position illustrated by broken line 210, with the center of crank pin 84 as represented by bolt 132 directly below center of rotation 170. Simultaneously, second connecting means 118 reaches its uppermost position, as indicated by the center of bearing 128 now lying directly above center point 170. Pistons 24 and 26 will be at the lower end of bylinders 18 and 20, and valve spools 32 and 34 will be offset near the upper ends of bores 22 and 23. Fluid supply is connected to the tops of both pistons, while exhaust is connected to the bottom of both pistons.

As the system continues to operate, the center of crank pin 84 (i.e., bolt 132) reaches a position 270° from the starting position, with bolt 132 to the right of center from center point 170. The upper portion of first connecting means 74 is now in the position illustrated by broken line 212. Driving fluid will be directed to the top of piston 34 and the bottom of piston 32, with the exhaust connected to the top of piston 32 and the bottom of piston 34. Thus, fluid pressure will continue to drive the pistons, rotating the output means.

As the various positions of first connecting means 74 shown in phantom in FIG. 3 illustrate, since the upper edge of first connecting means 74 rocks, and since bolt 110 must move in a slight arc due to the finite length of stabilizer arm or swinging link 106, if the lower ends of piston rods 28 and 30 were rigidly connected to openings 70 and 72 (as seen in FIG. 2), the piston rods would be forced to bend during piston movement. This would be very disadvantageous, causing wear and leakage between pistons and cylinder walls and between piston rods and packing. This can be a serious problem with the wide, thin pistons which are preferred in this engine. As described above, the C-shaped fittings 42 and 44 surrounding the ends of first connecting means 74 and pivotably connected thereto by links 58 and 60 compensate for the slightly non-linear movement of the connecting means ends during the engine operating cycle.

Details of the feed and exhaust valve system are provided in FIG. 4 in a schematic vertical section through heads 12 and 16 and block 14. While pistons 24 and 26 are not actually in the sme plane as valve spools 32 and 34 (as correctly shown in FIG. 1), they are schematically illustrated in the same plane in FIG. 4 for clarity of illustration.

As seen in FIG. 4, when both valve spools are in the uppermost position, the two pistons are slightly offset. Preferrably, one piston leads the other by about 30 to 40 degrees around the circle of rotation, relative to valve position, Optimum results have been obtained with an offset of about 37°. This offset is adjusted and set by moving and locking bolt 162 at the desired position along timing slot 160, as seen in FIG. 3.

Pistons 24 and 26 each includes conventional sealing rings 200 which slide against cylindrical sleeves 202 within cylinders 18 and 20. Similarly, valve spools 32 and 34 each includes conventional sealing rings 204 which slide against sleeves 206 within valve bores 22 and 23. For clarity of illustration, pistons 24 and 26 and valve spools 32 and 34 are not shown in section.

Valve bores 22 and 23 are each a basically cylindrical hole through block 14, with three enlarged cylindrical circumferential rings 208, 210 and 212, which communicate with the valve interiors through three rings of holes 214, 216 and 218, respectively, through sleeves 206.

Steam or other working fluid enters the engine through pipe 25 and a hidden channel in bar 27 (as seen in FIG. 1), then through holes (not shown) in block 14 to ring channels 210. The working fluid enters the space between the ends of spool valves 32 and 34 through sleeve holes 216, then passes out into ring channels 208 and 212, depending on whether holes 214 or 218 are uncovered. Arrow 220 illustrates one fluid path, from feed ring channel 210 through holes 216, holes 214, then to ring channel 208, through a transverse hole 222, next through a vertical channel between sleeve 202 and a channel cast into the wall of cylinder 20, up to a cross-over channel 226 formed in upper head 16 and finally into the cylinder space above piston 26. Meanwhile spent gases are exhausted from the cylinder along paths schematically illustrated by arrow 230. These gases pass through a cross-over channel 226 in lower head 12, through another vertical channel 224 and hole 222 to lower ring channel 212, then through holes 218 and out the end of the valve bore through channel 234 formed in the head which communicates with a conventional exhaust pipe (not shown).

Thus, many of the same channels are used both for introducing and exhausting the working fluid, depending on valve position. This system introduces the working fluid near the center of block 14, with the heated fluid passing through a channel against the piston sleeve so as to heat the cylinders and thus improve operating efficiency.

Details of the single main bearing which supports the engine output shaft 98 are provided in FIG. 5, a schematic vertical section taken along the output shaft centerline.

Bearing assembly 102 is secured to back wall 240 of housing 10 and to engine output shaft 98 to permit free shaft rotation while preventing longitudinal or angular shaft movement. This single cantilevered main bearing is entirely exterior to the engine, resulting in an economical system highly resistant to contamination from water or other contaminates within housing 10. To assure freedom from contamination, a conventional seal may be interposed between shaft 98 and wall 240 where the shaft passes through the wall. The bearing assembly basically consists of two flange mounted combination spherical and ball bearings. Spherical bearings made up of outer rings 242 and inner rings 244, with spherical mating surfaces, allow for slight system misalignment. Within inner rings 244 are mounted two conventional ball bearings 246 with the inner races in engagement with shaft 98. The two bearing assemblies are mounted in the proper spaced relationship and are secured to wall 240 by a plurality of bolts 248 which pass through tubular spacers 250. A cylindrical cover 252 covers the bearings preventing the introduction of contamination therebetween and helping support the spaced bearing sub-assemblies. If desired, cover 252 can be extended inwardly over the end of the bearing into close contct with shaft 98 to further prevent contamination. Also, bolts 248 may be irregularly spaced to assure that the bearing assembly is installed in only a single position.

While certain specific proportions, components and relationships of parts have been detailed in the above description of a preferred embodement, these may be varied, where suitable, with similar results. For exampe, a wide variety of pressurized gases, such as steam, Freon, pressurized carbon dioxide, etc., may be used to drive this engine.

Other ramifications, applications and variations will occur to those skilled in the art upon reading this application. Those are intended to be included within the scope of this invention, as defined in the appended claims.

What is claimed is:

1. In a fluid driven reciprocating engine which comprises an engine block containing at least two parallel cylinders, a piston located in each of said cylinders for parallel reciprocating movement therein, piston rods rigidly connected to each of said pistons extending out of said cylinders along the cylinder centerlines into a housing containing connecting means operatively connecting one end of each of said piston rods to a single crank pin on a rotary output shaft, and valve means within said block for selectively supplying fluid to and exhausting fluid from said cylinders above and below said pistons, the improvement wherein said crank pin is offset from the center of a disk shaped output plate having a central opening surrounding and secured to said rotary output means, a disk shaped timing plate fastened to said crank pin in an offset relationship so that said output plate and timing plate rotate together, and timing means fastened to said timing plate along the centerline of said crank pin, said timing plate connected to said valve means, whereby the position of said timing means may be varied to vary the positions of said valves relative to piston position.

2. The improvement according to claim 1 further including offset weights on said output plate to dynamically balance the mass of said crank pin during output plate rotation.

3. The improvement according to claim 1 wherein said timing plate is fastened to said crank pin by a plurality of bolts arranged in an irregular pattern whereby said timing plate can be fastened to said crank pin in only one position.

* * * * *